US006895864B2

(12) United States Patent
Ronn

(10) Patent No.: US 6,895,864 B2
(45) Date of Patent: May 24, 2005

(54) SUBCALIBRE KINETIC ENERGY PROJECTILE

(75) Inventor: Torsten Ronn, Karlskoga (SE)

(73) Assignee: Borfors Defence AB, Karlskoga (SE)

( * ) Notice: Subject to any disclaimer, the term of this patent is extended or adjusted under 35 U.S.C. 154(b) by 0 days.

(21) Appl. No.: 10/312,838

(22) PCT Filed: Jun. 20, 2001

(86) PCT No.: PCT/SE01/01408

§ 371 (c)(1),
(2), (4) Date: Jul. 11, 2003

(87) PCT Pub. No.: WO02/03009

PCT Pub. Date: Jan. 10, 2002

(65) Prior Publication Data

US 2004/0020398 A1 Feb. 5, 2004

(30) Foreign Application Priority Data

Jul. 3, 2000 (SE) ..... 0002481

(51) Int. Cl.[7] ..... F42B 12/58

(52) U.S. Cl. ..... 102/489; 102/394; 102/389; 102/494; 102/497; 102/506

(58) Field of Search ..... 102/489, 494, 102/497, 506, 389, 394, 229, 254, 258, 259, 491; 244/3.1

(56) References Cited

U.S. PATENT DOCUMENTS

| | | | | | |
|---|---|---|---|---|---|
| 1,241,095 | A | * | 9/1917 | Courtesy | 102/489 |
| 3,015,275 | A | * | 1/1962 | Victor et al. | 102/254 |
| 3,093,072 | A | * | 6/1963 | Pigman | |
| 3,451,306 | A | * | 6/1969 | Lagerstrom et al. | 102/259 |
| 3,744,421 | A | * | 7/1973 | Seeger | 102/254 |
| 3,899,975 | A | * | 8/1975 | Lawrence | |
| 3,954,060 | A | * | 5/1976 | Haag et al. | 102/494 |
| 4,157,068 | A | * | 6/1979 | Rognmo | 102/489 |
| 4,183,302 | A | * | 1/1980 | Schillreff | |
| 4,406,227 | A | * | 9/1983 | Beeker et al. | 102/489 |
| 4,455,940 | A | * | 6/1984 | Furuike | 102/489 |
| 4,567,809 | A | * | 2/1986 | Van Sloun | |
| 4,900,388 | A | | 2/1990 | Wyslotsky | |
| 5,107,768 | A | * | 4/1992 | Langenohl | 102/489 |
| 5,168,122 | A | * | 12/1992 | Furst et al. | 102/259 |
| 5,282,423 | A | | 2/1994 | Sikorski et al. | |
| 5,496,042 | A | | 3/1996 | Craft et al. | |
| 5,549,047 | A | * | 8/1996 | Borgni | 102/258 |
| 5,698,814 | A | * | 12/1997 | Parsons et al. | 102/479 |
| 6,389,976 | B1 | * | 5/2002 | Zacharin | 102/259 |
| H002025 | H | * | 6/2002 | Munsinger | 102/479 |

* cited by examiner

*Primary Examiner*—Michael J. Carone
*Assistant Examiner*—Lulit Semunegus
(74) *Attorney, Agent, or Firm*—Connolly Bove Lodge & Hutz LLP; Larry J. Hume

(57) ABSTRACT

The present invention relates to a segmented subcaliber projectile (1) subdivisible into a number of separate segments contiguous with each other at least initially to form an integral projectile of united segments or submunitions (5). The advantage with this subcaliber projectile is that since the segments or submunitions (5) are arranged sequentially after each other, each one comprises an explosive charge (7) initiatable by a very powerful shock and encased in an outer casing (6) of hard material such that the projectile in integral form can be used directly against heavy armor, and by means of dispersion of the various segments can also be used against aircraft.

14 Claims, 1 Drawing Sheet

SUBCALIBRE KINETIC ENERGY PROJECTILE

Figures 1, 2, 3:
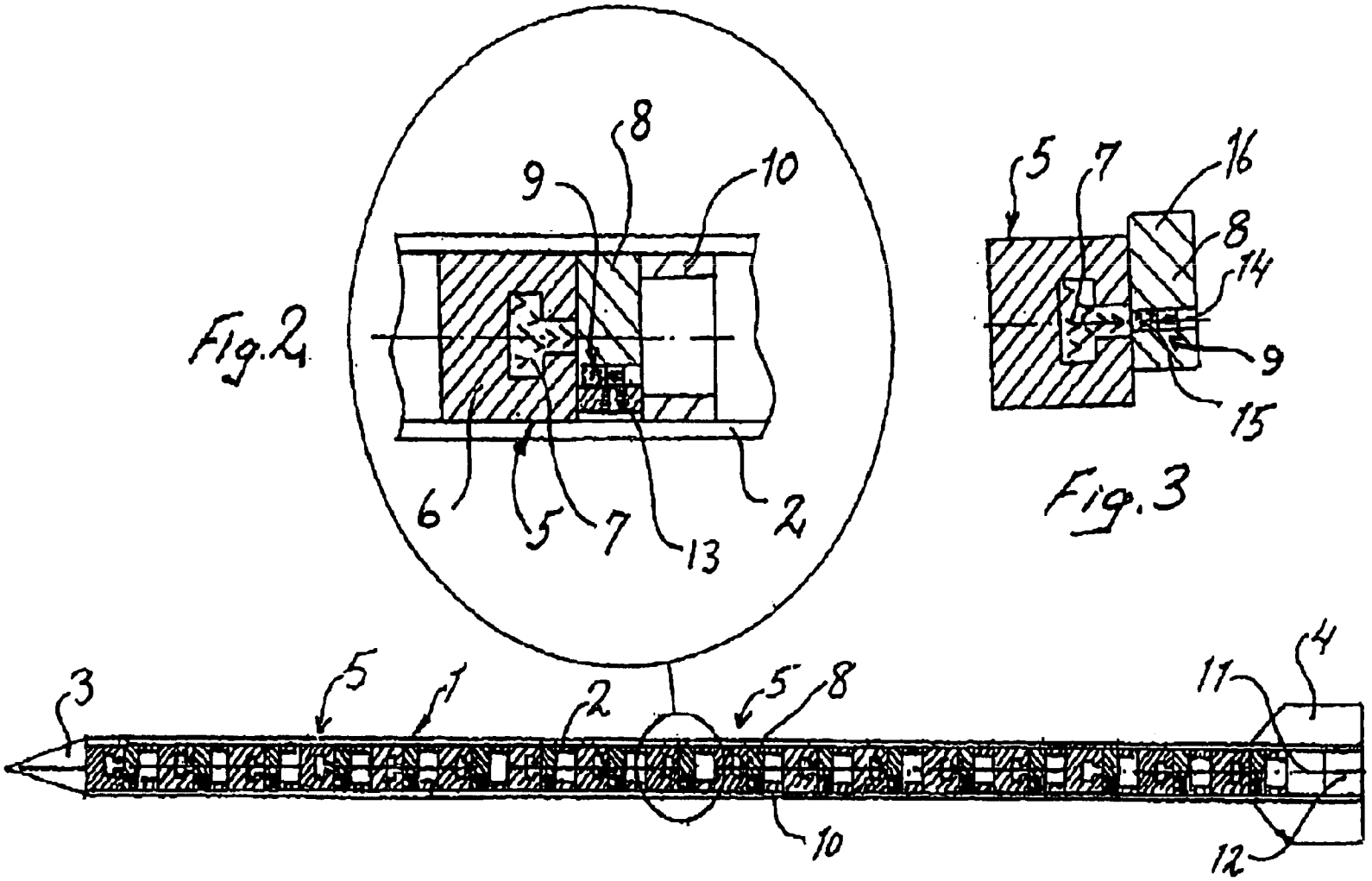

The present invention relates to a subcalibre projectile of preferably high velocity type, envisaged in its most developed form to be capable of being used to engage both heavily armoured targets and pure aircraft targets. The subcalibre projectile as claimed in the present invention thus has a very wide field of application. Both in its most elementary form and its most developed form it is highly effective against heavily armoured targets.

Previously, to achieve optimal effect in a specific target it has been necessary to use completely different types of projectiles against heavily armoured targets and aerial targets. In the former case the problem has been to penetrate the target, and in the latter case to cover a sufficiently large volume with active fragmentation or equivalent to ensure effect in a target whose definitive position in length, depth and height could only partially be pre-determined by target position measurement and advance calculations.

Originally, full calibre projectiles with reinforced nose cones or cores were used to engage armoured targets, but many years ago there was a changeover to using projectiles with shaped charge effect or subcalibre kinetic energy projectiles.

Earlier types of subcalibre projectiles achieved their effect in target mainly from their own kinetic energy and the inherent hardness of the projectile. Even if such projectiles can be given extremely high muzzle velocities when fired as subcalibre projectiles from a rifled or smooth bore barrel they are unsuitable for engaging aircraft as such projectiles are always dependent on achieving a direct hit to give in-target effect.

The objective of the present invention is to offer a new type of subcalibre projectile that in its most developed form is suitable for engagement of heavily and lightly armoured targets as well as aerial targets. The present invention relates to the actual projectile or to the main warhead effect. This presupposes that in one or other already known way the subcalibre projectiles are imparted with a suitable high velocity in a direction towards the target. Whether the projectile attains its high velocity from being fired from a gun barrel, or as the final stage in a missile, is thus irrelevant in this context.

As claimed in the present invention the subcalibre projectile is subdivisible into a number of separately acting segments or submunitions which, until the projectile reaches the immediate vicinity of the target, are held together as an integral subcalibre projectile. In its most elementary basic form its most characteristic feature is that each such segment contains an explosive charge that can be initiated by shock. Thus each segment has primarily the form of a thick-walled capsule of hard material encasing the explosive charge. A very powerful shock is necessary to initiate the explosive, otherwise safety aspects would be endangered. Such a powerful shock is generated by an impact against an armoured target.

The function thus is that the segment or submunitions one by one impact with the armour whereby first their outer casing provides effect in the armour, and subsequently their explosive content is initiated by the impact shock, possibly with a lower state than detonation or somewhat delayed. Each submunition thus delivers its kinetic energy plus the energy released by each detonation at the same point in the outer skin of the target, the combined effect of which will defeat the target. The explosive will also disseminate the residue from a previous submunition before the next one hits the target and detonates. Thus the objective is that each submunition shall be able to operate undisturbed by a previous one. This means that the various segments for the anti-armour application may need an intervening spacer between each other, as illustrated by the enclosed example. This is to ensure the undisturbed effect in target of the various segments or submunitions.

In the more developed form that also enables good warhead effect for combating aircraft, each segment is supplemented by a slide that engages a more conventional impact function and—as an appropriate safety measure—even a self-destruct function. Moreover, the subcalibre projectile also incorporates an SAI (safety, arming and ignition) unit, as well as a function for dispersing the various submunitions when the subcalibre projectile reaches the calculated position of the target. The latter function is appropriately in the form of a propelling charge which, when it is initiated, propels the submunitions out of the subcalibre projectile.

To achieve a suitable dispersion of the submunitions in and around the calculated position of the target the submunitions can incorporate a guidance device that automatically gives the desired dispersion or, alternatively, a pitch or yaw motion can be imparted to the subcalibre projectile to provide the desired dispersion. The individual submunitions can also incorporate deployable vanes, built-in imbalances, or other specific dispersion devices and, furthermore, the submunitions can be given a stable flight by means of a driving band or other method.

When engaging aircraft the objective is thus that the various segments, with their impact initiation functions built into their respective slides, shall be dispersed in the space around the calculated position of the target to enable impact with the target to eliminate it. When each submunition leaves the subcalibre projectile the slide shall thereby be displaced from safe position, in which its impact initiation function cannot actuate the initiation function of the segment, to armed position in which it initiates the explosive charge of the segment even with the relatively limited impact energy effected by impact with an aircraft. The general design of the slide is based entirely on already known techniques. Because the slides do not arm until each submunition leaves the subcalibre projectile and is dispersed, these initiation functions cannot disturb the successive initiation of the explosive charges in the segments in the anti-armour application whose initiation function is always armed.

Thus in its most developed form the subcalibre projectile as claimed in the present invention can be used directly against armoured targets and, after activation of a possible SAI unit, even against aircraft as well.

Dispersion of the submunitions from the subcalibre projectile can be effected on command from a proximity fuze, or be time-controlled based on computed fire control data.

The present invention is defined in the subsequent patent claims, and a preferred embodiment of the invention is shown in the appended figures in which the subcalibre projectile is designed such that the submunitions are located sequentially in a tubular subcalibre body, from which they are pushed out by a propelling charge initiated by the SAI unit.

FIG. 1 shows a longitudinal section through a subcalibre projectile as claimed in the present invention, while FIG. 2 shows a part from FIG. 1 to a larger scale, and FIG. 3 shows the same segment as in FIG. 2, but after the segment has left the subcalibre projectile and the slide has moved to armed position.

The subcalibre projectile 1 has a tubular body 2, a detachable nose cone 3, stabilisers 4, and inside there are a number of segments or submunitions 5, in this case with an outer casing 6 of heavy metal and an internal explosive charge 7. The latter is of a type that is initiated by the impact shock generated by direct impact with a hard target. There is also a slide 8 in which an initiator 9 is arranged. The purpose of the initiator 9 is to initiate the explosive charge when impacting with less hard targets such as aerial targets after the segments or submunitions 5 have separated from the subcalibre projectile. To enable this function the slide 8 must be displaced to the position shown in FIG. 3, i.e. in line with the explosive charge 7, which accordingly takes place after the segment 5 has left the tubular body 2 of the subcalibre projectile. In FIG. 2 and partially in FIG. 3 there is an indication of a spring 13 for displacing the slide to the position shown in FIG. 3, and a striker 14, and finally a priming composition 15. The striker 14 can be arranged to initiate the priming composition 15 on impact with the target, at a pre-determined point in time, or after a delay after impact with the target. When the initiation function comprising slide 8 is displaced to its armed position after the segment 5 leaves the cargo projectile, the outer corner 16 of the said slide automatically forms the dispersion actuating device necessary for depth dispersion of the various segments. A number of spacers 10 are also incorporated between the submunitions to enable the previous submunition, when in an anti-armour application, to dispense all its energy before it is the turn of the next submunition. Depending on the choice of material in the segment and the explosive, the spacers can be omitted subject to certain prerequisites.

In the rear section of the subcalibre projectile there is a propelling charge 11 for ejecting the submunitions 5 sequentially out of the tubular body 2. The propelling charge 11 is initiated by the SAI unit 12 arranged in the rearmost of the subcalibre projectile 1.

The outer casing of the segment 5 can be homogeneous, or can be prepared for a predetermined fragmentation with a specific pattern. The choice of material in the segments can be made within extensive limits to provide the effect stated in the general description.

What is claimed is:

1. A projectile, comprising:

a projectile body;

a plurality of separate submunitions disposed within the projectile body, wherein the submunitions are arranged sequentially along an axis of the projectile body, wherein each submunition comprises a movable slide that is displaceable from a safe position to an armed position; and a propelling charge arranged in the projectile body sequentially eject the submunitions out of the projectile body, wherein each submunition comprises:

an initiator within the slide; and a striker within the slide disposed to initiate a priming composition of the initiator.

2. The projectile of claim 1, wherein each submunition comprises:

a casing; and an explosive charge within the casing, wherein when the movable slide is in the armed position, the initiator is disposed to initiate the explosive charge.

3. The projectile of claim 1, wherein the movable slide comprises:

an outer corner, wherein when the slide is in the armed position, the outer corner acts as a dispersion actuating device for the submunition.

4. The projectile of claim 1, comprising:

a plurality of spacers, each spacer being disposed between two adjacent submunitions.

5. The projectile of claim 1, wherein the propelling charge is disposed at a rear section of the projectile.

6. The projectile of claim 1, comprising:

a nose cone; and a plurality of stabilizers at a rear section of the projectile.

7. The projectile of claim 1, wherein each submunition comprises:

a spring for displacing the slide to its armed position.

8. A projectile, comprising:

a projectile body; and a plurality of separate submunitions disposed within the projectile body, wherein the submunitions are arranged sequentially along an axis of the projectile body, wherein each submunition comprises:

a casing;

a movable slide adjacent the casing; and an initiator within the slide, wherein the movable slide is displaceable from a safe position to an armed position after the submunition is ejected from the projectile body, wherein the movable slide comprises:

an outer corner, wherein when the slide is in the armed position, the outer corner acts as a dispersion actuating device for the submunition, wherein each submunition comprises:

a spring for displacing the slide to its armed position; and a striker within the slide disposed to initiate a priming composition of the initiator.

9. The projectile of claim 8, comprising:

a propelling charge arranged at a rear section of the projectile body to sequentially eject the submunitions out of the projectile body.

10. The projectile of claim 8, wherein each submunition comprises:

an explosive charge within the casing, wherein when the movable slide is in the armed position, the initiator is disposed to initiate the explosive charge.

11. The projectile of claim 10, comprising:

a plurality of spacers, each spacer being disposed between two adjacent submunitions.

12. The projectile of claim 10, comprising:

a nose cone; and a plurality of stabilizers at a rear section of the projectile.

13. The projectile of claim 10, wherein each submunition comprises:

a spring for displacing the slide to its armed position; and a striker within the slide disposed to initiate a priming composition of the initiator.

14. The projectile of claim 8, comprising:

a plurality of spacers, each spacer being disposed between two adjacent submunitions.

* * * * *